US007631610B1

(12) United States Patent
Wolske

(10) Patent No.: US 7,631,610 B1
(45) Date of Patent: Dec. 15, 2009

(54) VARIABLE AREA TRIM TAB AND MEANS TO CONTROL WATER FLOW ALONG A TRIM TAB AND ADDED PROPELLER GUARD INCLUDING TUNNEL PROPELLERS

(76) Inventor: James P. von Wolske, 2107 Lakeshore Dr., Austin, TX (US) 78746

( * ) Notice: Subject to any disclaimer, the term of this patent is extended or adjusted under 35 U.S.C. 154(b) by 0 days.

(21) Appl. No.: 11/550,724

(22) Filed: Oct. 18, 2006

Related U.S. Application Data

(60) Provisional application No. 60/728,360, filed on Oct. 19, 2005.

(51) Int. Cl.
*B63B 1/22* (2006.01)

(52) U.S. Cl. ..... 114/285

(58) Field of Classification Search ..... 114/285–287
See application file for complete search history.

(56) References Cited

U.S. PATENT DOCUMENTS

| | | | | |
|---|---|---|---|---|
| 3,200,782 | A | 8/1965 | Walden et al. | |
| 3,561,389 | A * | 2/1971 | Hunt | 114/285 |
| 3,565,030 | A | 2/1971 | Curtis | |
| 4,597,742 | A | 7/1986 | Finkl | |
| 4,846,741 | A | 7/1989 | Betsinger | |
| 4,896,622 | A | 1/1990 | Thomas | |
| 4,909,175 | A | 3/1990 | Arnseson | |
| 4,915,828 | A * | 4/1990 | Meyers et al. | 210/110 |
| 4,967,682 | A * | 11/1990 | O'Donnell | 114/286 |
| 5,100,350 | A | 3/1992 | Buzzi | |
| 5,171,175 | A | 12/1992 | Buzzi | |
| 5,193,478 | A * | 3/1993 | Mardikian | 114/285 |
| 5,215,029 | A | 6/1993 | Davis | |
| 5,667,415 | A | 9/1997 | Arneson | |
| 6,089,177 | A * | 7/2000 | Muller | 114/285 |
| 6,138,601 | A | 10/2000 | Anderson | |
| 6,464,549 | B2 | 10/2002 | Buzzi | |
| 6,571,724 | B1 | 6/2003 | Shen | |
| 6,684,807 | B1 | 2/2004 | Smith | |
| 6,745,715 | B1 | 6/2004 | Shen et al. | |
| 6,823,812 | B2 * | 11/2004 | von Wolske | 114/286 |
| 6,851,991 | B2 | 2/2005 | Eriksson | |
| 6,863,013 | B2 | 3/2005 | Noyes, Jr. | |

* cited by examiner

*Primary Examiner*—Stephen Avila
(74) *Attorney, Agent, or Firm*—Gary R. Stanford

(57) ABSTRACT

A variable area trim tab which is adjustable to control its effective area of the trim tab for use on boats having any of several propulsion methods. Area control is used to vary the effective lift area of the trim tab and to control the water flowing to, or flooding, the propeller. Flood doors and flood gates may be water blocking style, or water passing style to control water flow to the propeller. Area control and flood control components are also used as propeller guards, or propeller screens. Tunnel propellers use sliding and hinged tunnel closures to control water flow to the propeller. Sliding closures serve as propeller guards when the propeller is in the raised position. Side inlet water flow pipes allow water to fill propeller tunnels and serve as a side thruster propeller housing.

18 Claims, 15 Drawing Sheets

VARIABLE AREA TRIM TAB AND MEANS TO CONTROL WATER FLOW ALONG A TRIM TAB AND ADDED PROPELLER GUARD INCLUDING TUNNEL PROPELLERS

CROSS-REFERENCE TO RELATED APPLICATIONS

This application claims the benefit of U.S. Provisional Application Ser. No. 60/728,360, filed on Oct. 19, 2005, which is herein incorporated by reference for all intents and purposes.

BACKGROUND OF THE INVENTION

1. Field of the Invention

The present invention relates to boating, and more specifically to a variable area trim tab system and method to control water flow along a trim tab and added propeller guard including tunnel propellers.

2. Description of the Related Art

Trim tabs are historically used to control the flight attitude of a boat by changing the localized slope of a portion of the bottom surface of the boat. Prior art trim tabs may be attached to the boat hull by hinges or solidly affixed and may either be held rigid or be made to flex by control means. Existing trim tabs are not configured to be controlled to allow increased water flow to the propeller. Existing trim tabs that are located in front of, and below, the propeller are used to limit variations of propeller blade immersion. Existing trim tabs are known which have flow limiting flood walls or flood curtains to decrease the flow of water to the propeller. Such existing trim tabs do not have means to increase the flow of water to the propeller.

Adding trim tabs to a boat changes the overall wetted area footprint of a bottom of the boat and thus will usually change the flight attitude of the boat. Boats with a propeller in a tunnel may have a fixed geometry closure panel as a continuation of the boat's bottom surface. For example, U.S. Pat. No. 6,464,549 to Buzzi (Buzzi '549) refers to the closure panel as a "ground wall", but it is in a fixed position and has only one opening and that is located where the propeller shaft emerges from the rearward end of a tunnel near the propeller. Buzzi '549 describes the tunnel as having only a single opening and is not classified as a trim tab but instead as means to control flow around a propeller. The mere presence of Buzzi's closure in contact with the flowing water, however, changes the wetted footprint of the bottom of a boat. Although the area of Buzzi's closure may be small and its contribution to the flight attitude may be small, it still exists and has the flavor of a trim tab. U.S. Pat. No. 4,909,175 to Arnseson (Arnseson '175) shows a flexing trim tab attached to the boat bottom forward of the stern. Prior art trim tabs do not include a propeller guard to protect the propeller from being damaged or propeller screens to protect swimmers or marine mammals.

BRIEF DESCRIPTION OF THE DRAWINGS

The benefits, features, and advantages of a variable area trim tab system according to the present invention will become better understood with regard to the following description, and accompanying drawings, in which.

DETAILED DESCRIPTION

Figure 1:
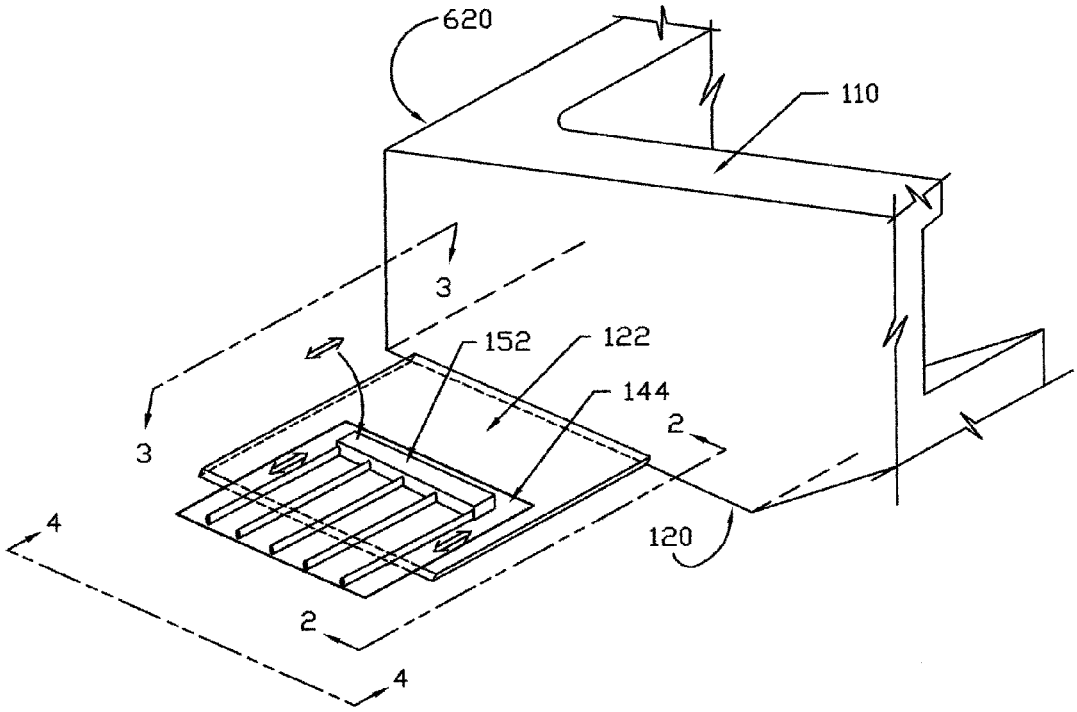
FIG. 1 is a perspective view of a portion of the left side rear end of a boat having a trim tab with a variable area trim tab and propeller guard mounted at the stern near the bottom surface of the boat.

The following description is presented to enable one of ordinary skill in the art to make and use a variable area trim tab system according to the present invention as provided within the context of a particular application and its requirements. Various modifications to the preferred embodiment will, however, be apparent to one skilled in the art, and the general principles defined herein may be applied to other embodiments. Therefore, a system and method according to the present invention is not intended to be limited to the particular embodiments shown and described herein, but is to be accorded the widest scope consistent with the principles and novel features herein disclosed.

A variable area trim tab system according to one embodiment described herein includes a means to extend or retract a portion of a trim tab to change the area of the trim tab. This change of area includes a means to retract a portion of the trim tab to enable increased flow of water to a propeller. This change of area includes a means to permit increased flow of water to a propeller by selectively opening holes in the bottom of the trim tab to permit water to rise up into the propeller. One embodiment includes a means to integrate a retractable propeller guard with the trim tab. A variable area trim tab system as described herein may be used on boats that have a propeller that can be raised vertically, or jacked up and down, and can also be used on boats that have propellers that are at a fixed vertical height.

A variable area trim tab system according to another embodiment includes a boat that has a propeller that can be adjustably lowered below, or raised above, the trim tab. The extension on the trim tab can be used on a boat that has an outboard motor or an inboard/outboard drive that can be raised, by jacking means, above the plane of the trim tab. Similarly, the trim tab may be used on a boat that has a surface drive propeller that can be raised up or lowered below the plane of the trim tab.

A variable area trim tab system according to one embodiment may be used on a boat that has a surface drive that has a propeller at a fixed height. Another embodiment may be used on a surface drive propeller that is housed in a tunnel in the bottom of the boat. Another embodiment may be used on a submerged propeller style inboard boat with a direct drive propeller shaft that angles out and downwards through the bottom of the boat towards the rear of the boat. Another embodiment may be adjusted downward and the trim tab extension can be extended to a position under the propeller to function as a propeller guard.

The trim tab extension may be of a water blocking type that prevents water from flooding the propeller from below. Conversely, the trim tab extension may be a water screen that allows water to flood the propeller from below. Either type of trim tab extension serves as a physical barrier to prevent objects from being struck by the rotating propeller.

A variable area trim tab system according to various embodiments are of particular utility to surface piercing propeller drives to serve as a water flow control means to regulate flooding of the propeller and to serve as a propeller guard.

A variable area trim tab system according to one embodiment provides an improvement to boats with tunnel propellers that can be raised up into the tunnel and have a fixed tunnel closure or prior art "ground wall". The improvement comprises the addition of a trim tab extension, and a water screen, and a water flood hole, and includes the means to controllably slide the prior art fixed tunnel closure in forward or rearward motion. Any of these four additions help control the flow of water into the propeller and can serve as a propeller guard. Boats having tunnel propellers that can be raised up into the tunnel can be supplied with water from a water pipe connecting the sidewall of the tunnel to the exterior sidewall of the hull. The water pipe can be fitted with a small propeller inside for use as a side thruster for docking or other slow speed maneuvers.

A variable area trim tab system according to other embodiments may be used with a hinged trim tab to provide ride control at various speeds and can use the extendable trim tab section to serve as a propeller guard or propeller screen on boats having propellers mounted at a fixed height relative to the boat bottom, such as, for example, outboard motors, inboard/outboard drives, surface drives, and straight inboards.

Boats having a surface propeller in a tunnel and mounted in a fixed lowered position have an extendable trim tab extension and a hinged tunnel closure according to another embodiment to control the flow of water to the propeller and alternatively extends to serve as a propeller guard or propeller screen. Boats having fixed straight drive inboard propellers have a bottom mounted trim tab with an extendable trim tab section according to another embodiment that can serve as a propeller guard or propeller screen. This propeller screen is particularly useful for water-ski style boats that operate where people are in the water.

A trim tab extension according to one embodiment may be made of water blocking construction, for example a solid sheet metal plate, or may be made of a water passing construction, for example a perforated metal plate, a wire mesh screen, a comb, or a rake to allow partial passage of water while serving as a propeller screen to protect swimmers from propeller strikes. Therefore, it is mostly a matter of percentage of free area to pass water that determines whether the extension is a "trim tab", or a "propeller guard", or a "propeller screen". Often, it serves multiple functions. The boat driver can invoke any or all to meet the necessary operating conditions.

FIG. 1 is a perspective view of the rear end of a boat with a hull bottom extension in the form of a trim tab 122 and shows a relatively simple embodiment. Only one trim tab is shown, however they are usually mounted in symmetric pairs on either side of the longitudinal center plane of the boat. A single center mounted trim tab may be appropriate on flat bottom boats. The boat 110 includes an exterior boat side wall 620 and a bottom surface 120. Trim tab 122 is mounted near the boat bottom surface 120 and usually mounted near the bottom of the transom. FIG. 1 clearly shows a vertical wall at the rear of the boat known as a transom, however, on modern boats, the transom is often ill defined. However, the boat bottom surface causes water to flow along the boat bottom surface 120 to the bottom surface of the trim tab 122 without incurring a major discontinuity.

According to one embodiment, a trim tab extension 144 slides forward or rearward in a controllable fashion to increase or decrease the area of the trim tab 122. Therefore, the constant area of prior art trim tab becomes a variable area trim tab by changing the length of the tab. This change in area changes the hydrodynamic characteristics of the trim tab. Located on top of the trim tab extension is a propeller guard 152 that also slides forward and rearward. The trim tab is fastened or mounted to the boat in any one of many methods, such as including hinges or it may be solidly mounted to include a trim tab that is totally rigid or one that is allowed to flex.

Figure 2:
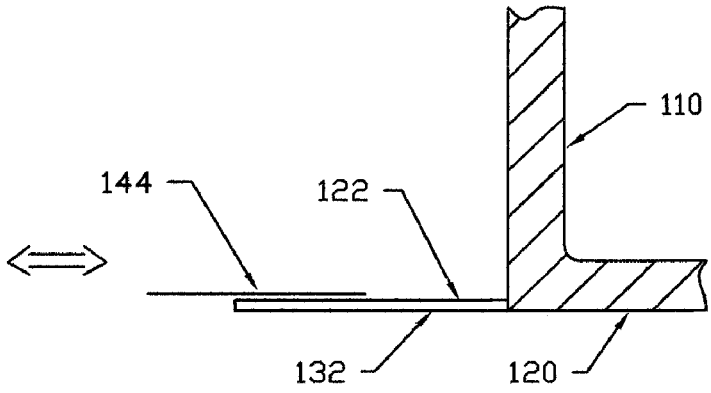
FIG. 2 is a simplified side view of FIG. 1, as indicated from section line 2-2, but without the propeller guard for clarity.

FIG. 2 is a section view taken along section line 2-2 of FIG. 1, and represents somewhat of a side view. Boat bottom surface 120 is shown as part of the cross section of the boat 110 and trim tab 122 is mounted to the boat near the boat bottom surface. The trim tab bottom surface 132 forms a continuation of the boat bottom surface 120 and water flows from right to left in the Figure along the length of the trim tab. However, it is noted that some trim tab installations mount the trim tabs in a more horizontal fashion rather than parallel to the bottom and often mount the tabs somewhat above the bottom of the boat. Either installation practice is within the scope of the present invention. Trim tab extension 144 is shown mounted along the top surface of the trim tab. The bold arrow to the left of the Figure indicates that the trim tab extension can be moved left and right along the length of the trim tab.

Figure 3:
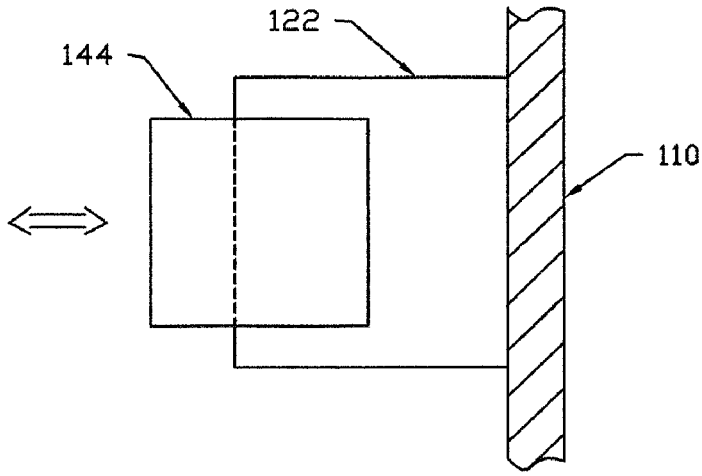
FIG. 3 is a simplified top view of FIG. 1, as indicated from section line 3-3, but without the propeller guard for clarity.

FIG. 3 is a section view taken along section line 3-3 of FIG. 1, and represents somewhat of a top view. The double arrow indicates that the trim tab extension 144 slides rearward and forward above trim tab 122 to cause an increase and decrease in the area of the trim tab as a total system.

Figure 4:
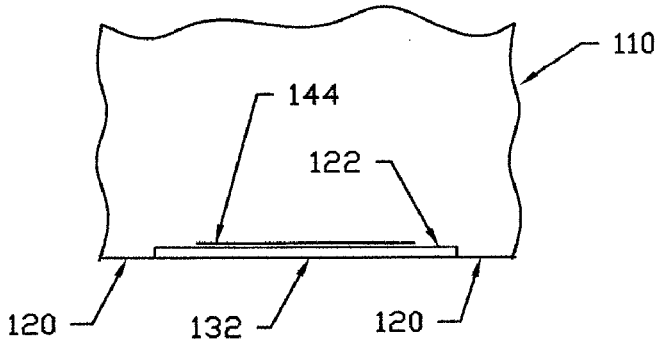
FIG. 4 is a simplified rear view of FIG. 1, as indicated from section line 4-4, but without the propeller guard for clarity.

FIG. 4 is a section view taken along section line 4-4 of FIG. 1, and represents somewhat of a rear end view, but is rotated for graphic simplification as though the boat bottom 120 is horizontal. The trim tab extension 144 moves out of or into the plane of the paper to increase or decrease the effective area of the trim tab 122.

Figure 5:
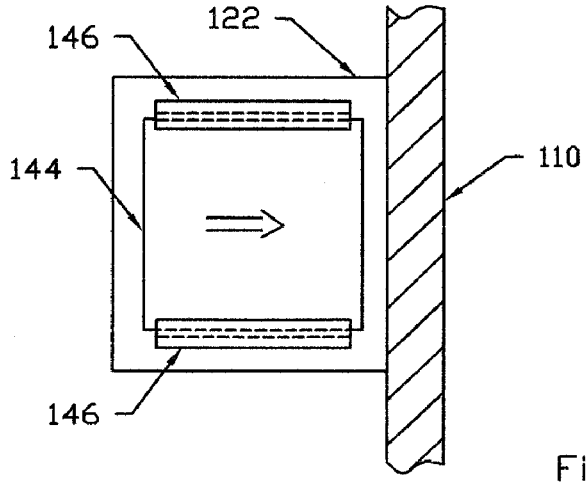
FIG. 5 is a top view of a trim tab on the rear end of a boat, similar to FIG. 3, with the trim tab extension in the retracted or forward position.

FIG. 5 shows a top view of the trim tab extension 144 retracted forward to reside on top of trim tab 122 to thus minimize the area of the trim tab. Guide rails 146 are fastened to trim tab 122 and constrain trim tab extension 144 to move in a forward and rearward motion.

Figure 6:
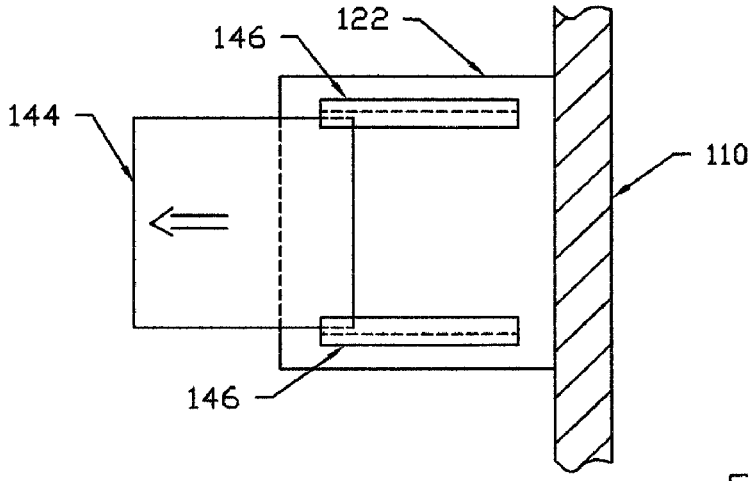
FIG. 6 is a top view of FIG. 5, with the trim tab extension in the extended or rearward position.

FIG. 6 shows a top view of the trim tab extension 144 fully extended rearward relative to trim tab 122 to cause an increase in the effective area of the trim tab assembly.

Figure 7:
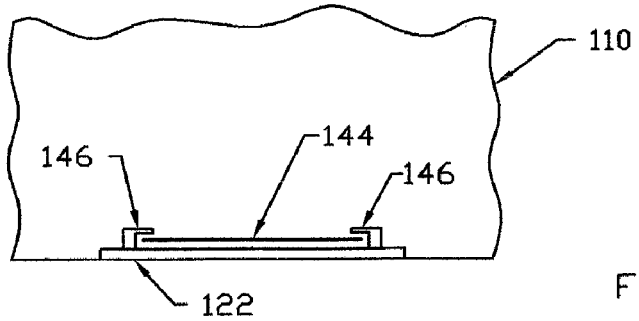
FIG. 7 is a rear end view or a boat, similar to FIG. 4, and shows the guide rails for the trim tab extension.

FIG. 7 is an rear end view of FIG. 5 and FIG. 6, and shows guide rails 146 mounted along the edges of trim tab 122 and thus forming a captive slot to allow trim tab extension 144 to slide forward as in FIG. 5 and to slide rearward as in FIG. 6 relative to trim tab 122.

Figure 8:
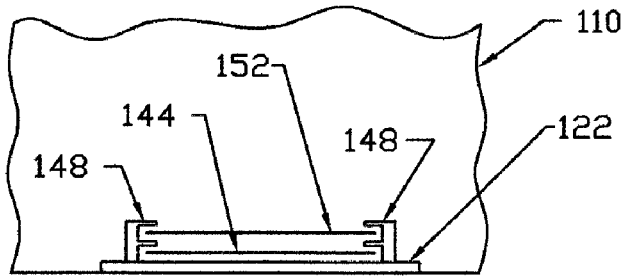
FIG. 8 is a rear end view of a boat showing dual channel guide rails for trim tab extension plus a propeller guard.
Figure 46:
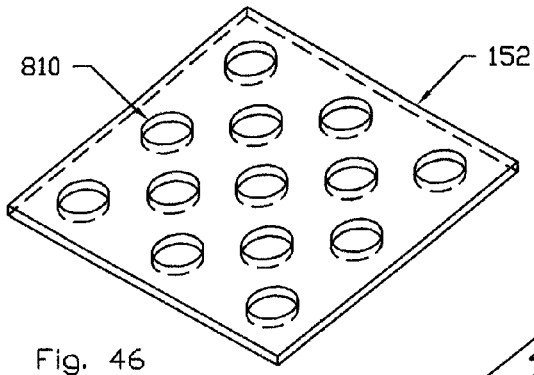
FIG. 46 is a partial perspective view of a trim tab extension or propeller guard comprised of a perforated plate.
Figure 47:
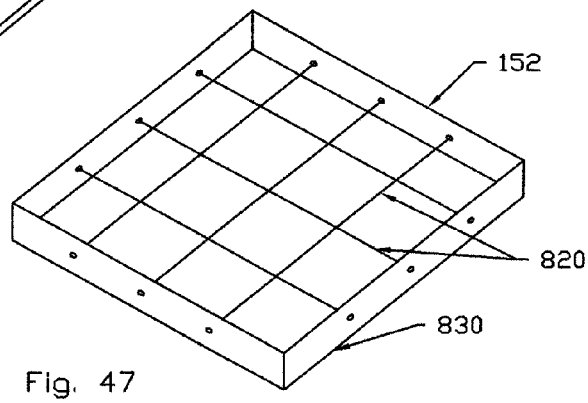
FIG. 47 is a partial perspective view of a trim tab extension or propeller guard comprised of a coarse wire screen.
Figure 48:
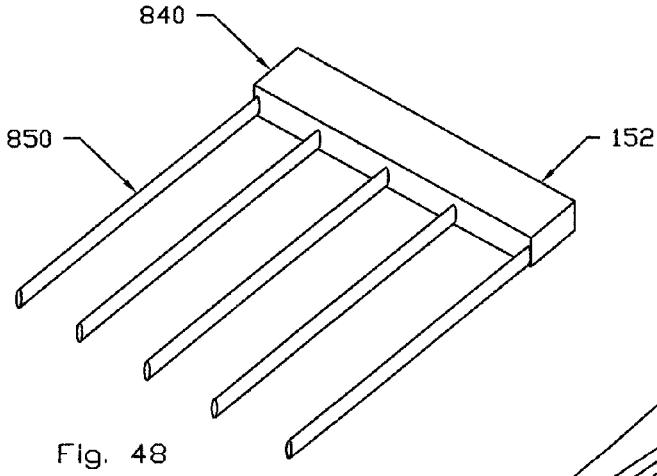
FIG. 48 is a partial perspective view of a trim tab extension or propeller guard comprised of a comb with coarse extended teeth.
Figure 49:
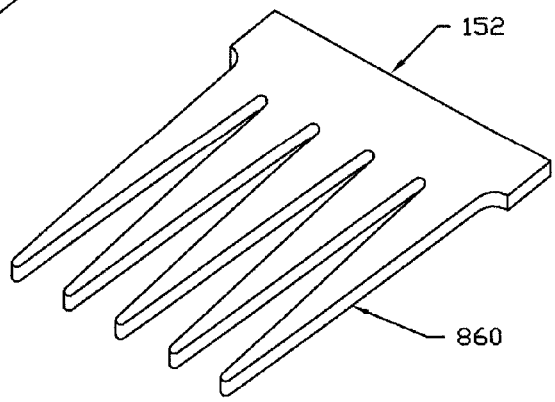
FIG. 49 is a partial perspective view of a trim tab extension or propeller guard comprised of a rake with tapered teeth.

FIG. 8 is a rear end view showing double groove guide rails 148 similar to guide rails 146. The double groove guide rails allow two separate devices to each slide independently in its respective groove. Trim tab extension 144 is typically a non-water passing plate of thin sheet metal or the like. Water screen 152 is typically a water passing plate with holes punched through (as shown in FIG. 46), or may be a wire mesh screen (as shown in FIG. 47), or may be a comb like structure (as shown in FIG. 48), or may be a rake like structure (as shown in FIG. 49). The water screen 152 can be considered functionally similar to the trim tab extension 144 because either can be extended rearward from the trim tab 122 and although the water screen has less flow impedance, hence it does not provide as effective as a trim surface, the impedance is simply a matter of degree. Also, the function of the trim tab extension serves as a propeller guard in addition to a hydrodynamic planing surface, and also as a means to control the flow of water into the propeller.

Figure 9:
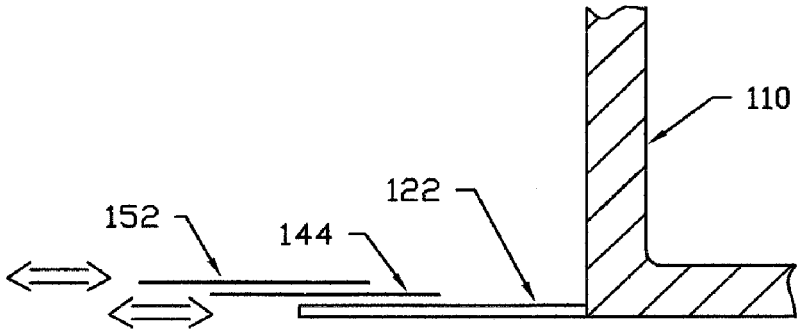
FIG. 9 is a side view of FIG. 8, and shows a trim tab and a trim tab extension and propeller guard, but omits the guide rails for clarity.

FIG. 9 is a side view showing that trim tab extension 144 can be extended partially and water screen 152 can be extended fully rearward. The water screen may contribute somewhat as a planing surface, but it also acts as a propeller guard as shown in later figures and yet it still allows water to flood up around a propeller raised above the trim tab.

Figure 10:
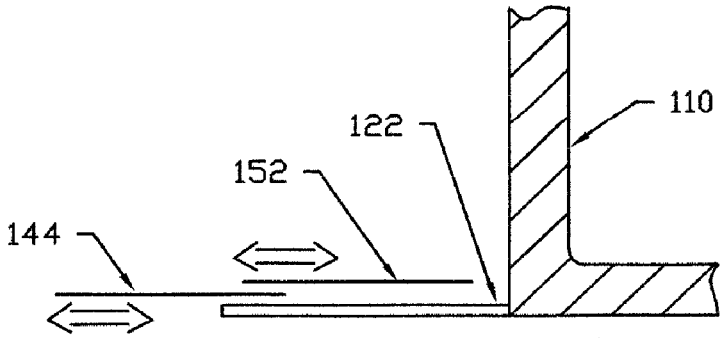
FIG. 10 is a side view of a boat with a trim tab showing that either the trim tab extension or the propeller guard can be extended or retracted independently.

FIG. 10 is a side view similar to FIG. 9 and shows the trim tab extension 144 fully extended rearward and the water screen 152 fully retracted. The bold arrow near each component indicates that the position of the trim tab extension and the water screen are independent of each other.

Figure 11:
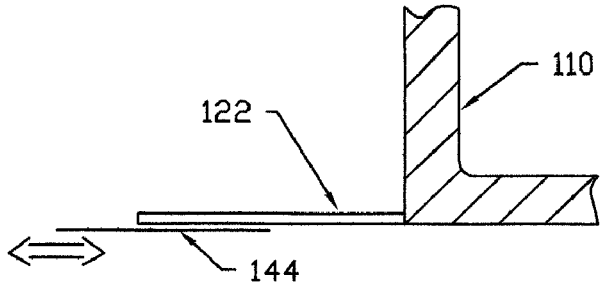
FIG. 11 is a side view of a boat with a trim tab showing a trim tab extension below the trim tab.

FIG. 11 is a side view of the rear end of a boat showing that the trim tab extension 144 may be located below the trim tab 122.

Figure 12:
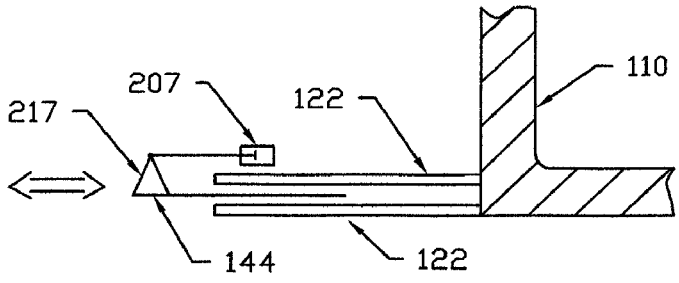
FIG. 12 is a side view of a boat showing the trim tab as a pocket style assembly and the trim tab extension as mounted within the pocket.

FIG. 12 is a side view of the rear end of a boat showing that trim tab 122 may be comprised of an upper half and a lower half thus forming a pocket to allow the trim tab extension 144 to slide in and out. A linear actuator 207 provides forward and rearward position control and is connected to the trim tab extension by mounting lug 217.

Figure 13:
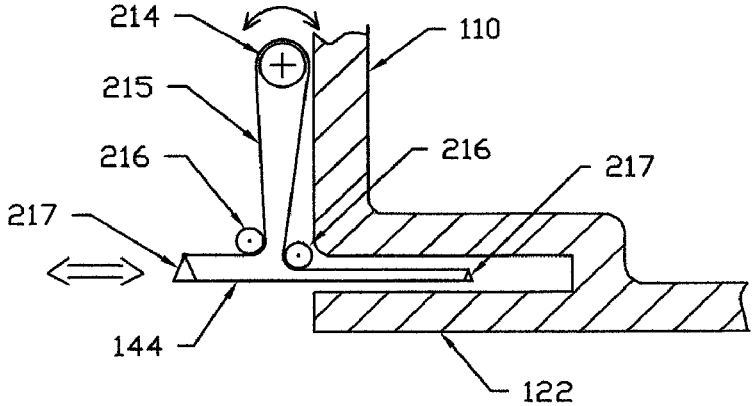
FIG. 13 is a side view of a boat showing the trim tab extension as located in a pocket in the boat hull.

FIG. 13 is a side view of the rear end of a boat showing that trim tab extension 144 may be mounted into a pocket in the hull bottom. The extension of the hull below trim tab extension 144 is considered to be a fixed trim tab because the extension of the hull is external to the wetted barrier of the hull. This type of hull extension is typically rigid and not adjustable and does not contribute significantly to the static buoyancy of the hull. Nevertheless, the hull extension interacts with the water when the boat is moving, so that it is considered herein to function as a fixed trim tab that collectively operates with trim tab extension 144 to form a variable area trim tab. Trim tab extension 144 is inserted and withdrawn from the pocket in the hull by means of cable 215 wrapped around drive pulley 214 and passed over idler pulleys 216 and attached by mounting lugs 217. Other means are available.

Figure 14:
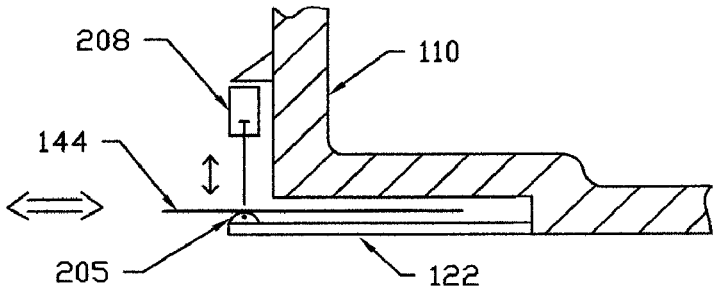
FIG. 14 is a side view of a boat showing the trim tab extension as located in a pocket between the hull and an adjustable trim tab.

FIG. 14 is a side view of the rear end of a boat showing a trim tab 122 attached to the hull at a location considerably forward of the rear end of the hull. This configuration is adjustable up and down by means of trim ram 208 connected by ram ear 205 to trim tab 122. A trim tab extension 144 varies the area of the trim tab system by sliding the trim tab extension rearward to effectively increase the tab length or by sliding the trim tab extension forward to effectively decrease the tab length. It is contemplated that the trim tab extension can also be a water screen to allow water to pass through and upward to flood the propeller while acting as a propeller guard.

Figure 15:
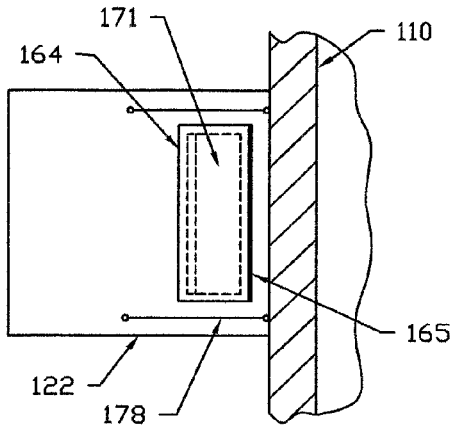
FIG. 15 is a top view of the rear end of a boat and shows a flood door to change the effective area of the trim tab.

FIG. 15 is a top view of a trim tab, but does not use a trim tab extension to control the area of the trim tab system, but rather uses a flood door 164 that is attached by flood door hinge 165 to trim tab 122 to open a flood hole 171 and therefore admit water up from below to the top side of the trim tab. Although the gross length of the trim tab is not changed using this method, the net effect is similar because the effective planing area of the trim tab is changed when the flood door is opened. This method is useful in providing extra water to a propeller in a surface drive propeller application as may be necessary to get the boat up on plane. It is a means to control the flow of water to the propeller.

Figure 16:
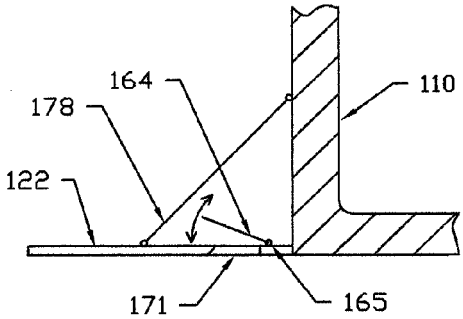
FIG. 16 is a side view of FIG. 15, and shows the flood door opening action.

FIG. 16 is a side view of FIG. 15 and shows the flood door 164 hinged to trim tab 122 and how the flood door swings to open and close the flood hole 171. A pair of braces 178 is shown on each side of trim tab 122 to provide rigidity to accommodate for the loss of material due to the hole in the trim tab.

Figure 17:
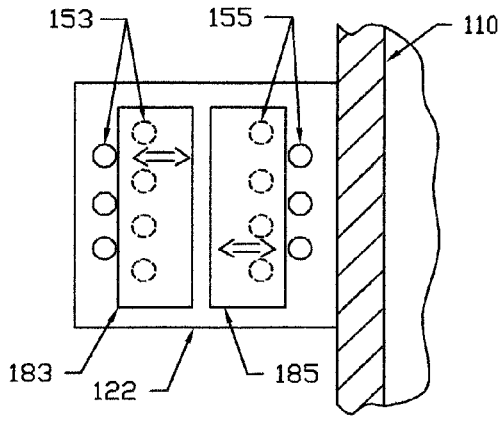
FIG. 17 is top view of a boat showing the flood door replaced by through holes and flood gates.

FIG. 17 is a top view of a trim tab with a group of smaller flood holes judiciously staggered across trim tab 122. These smaller forward holes 155 are located nearest to the boat and rearward holes 153 are located rearward on the trim tab. Forward slide plate 185 slides forward and rearward to selectively cover one or more forward flood holes and control water flow up through the forward holes, and rear slide plate 183 also slides forward and rearward to selectively cover one or more rearward flood holes and control water flow up through the rearward flood holes.

Figure 18:
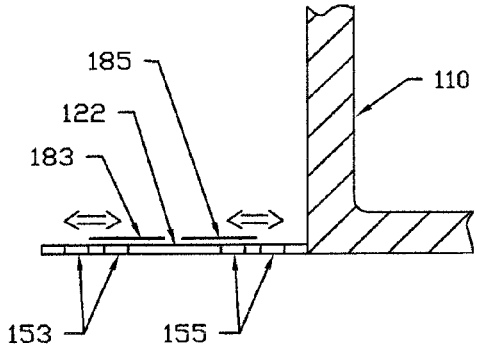
FIG. 18 is a side view of FIG. 17, and shows the flood gates moving forward and rearward to control the water flow through the flood holes.

FIG. 18 is a side view of FIG. 17 and shows the flood holes, forward holes 155 and forward slide plate cover 185 and rearward holes 153 and rearward slide plate cover 183. The use of flood holes does not change the gross area of the trim tab 122, however, opening and closing the holes does change the net area and hydrodynamic characteristics of the trim tab so that the collective system functions as a variable area trim tab.

Figure 19:
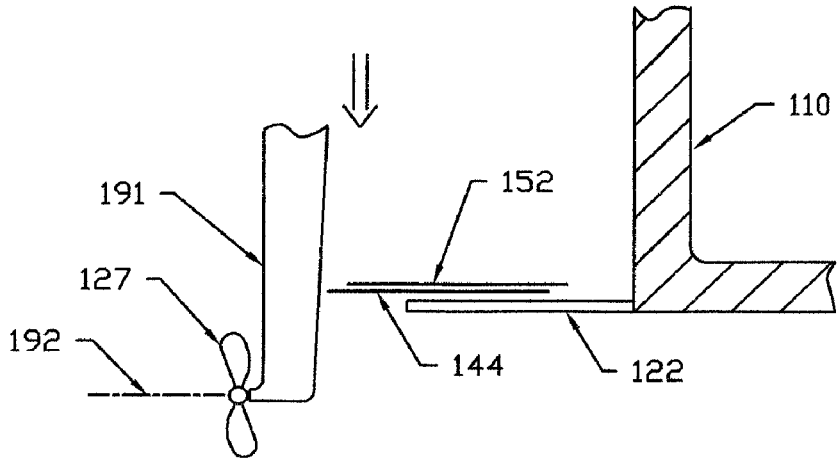
FIG. 19 is a side view of the rear end of a boat with an outboard motor in a lowered position behind the trim tab.

FIG. 19 is a side view of a trim tab and shows the lower unit 191 portion of an outboard motor or an inboard/outboard drive, including the propeller 127 and the propeller shaft axis 192. In this view, the propeller is located below the trim tab for full immersion of the propeller. Trim tab 122 works in the usual fashion adding hydrodynamic trim to the boat and the trim tab extension 144 is mostly retracted to prevent it from being struck by the lower unit. A water screen 152 is located above the trim tab extension.

Figure 20:
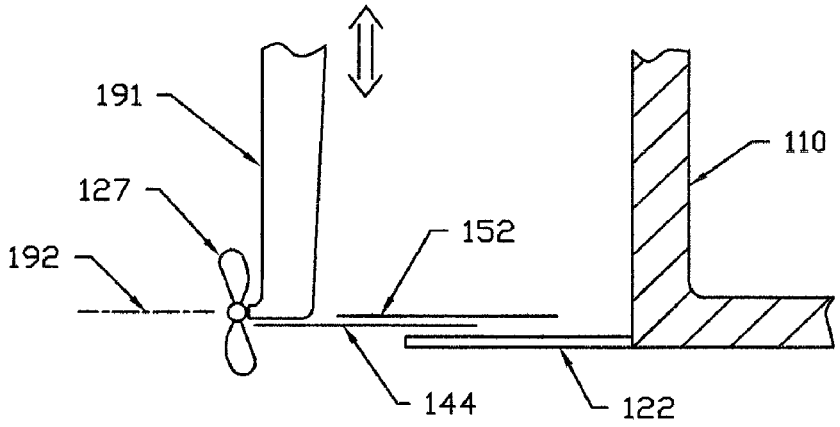
FIG. 20 is a side view of FIG. 19, with the outboard motor in a partially raised position and the trim tab extension in a partially extended position.

FIG. 20 is a side view of the same components as in FIG. 19, but shows the lower unit 191 in a partially raised position such that only the lower half of the propeller 127 is below the trim tab 122. This mode of operation is normal for high-speed operation of surface piercing propellers. FIG. 20 shows the lower half of the propeller immersed in the water, with the top half of the propeller rotating in free air space when the boat is operating at high speed. A commercially available jack plate (not shown) is used to raise or lower the entire outboard motor, or a jack box (not shown) is used to raise or lower the lower unit of an inboard/outboard drive unit. The trim tab extension 144 is extended under the foot of the lower unit to limit variations in propeller blade immersion as the boat bounces across the water and waves. The water screen 152 is retracted towards the front of the boat because it does not play a role in operation at these high speeds. However, it should be noted that trim tab 122 ends considerably forward of the lower unit in anticipation of some boats requiring a large quantity of water to "feed the propeller", that is to cause the water to well up or rise up, around, and over the propeller when trying to get the boat up over hump speed or to get the boat on plane. Certain propellers will blow all the water away from the lower unit and cause the propeller to cavitate when the engine is sped up yet while the boat is moving slowly.

Figure 21:
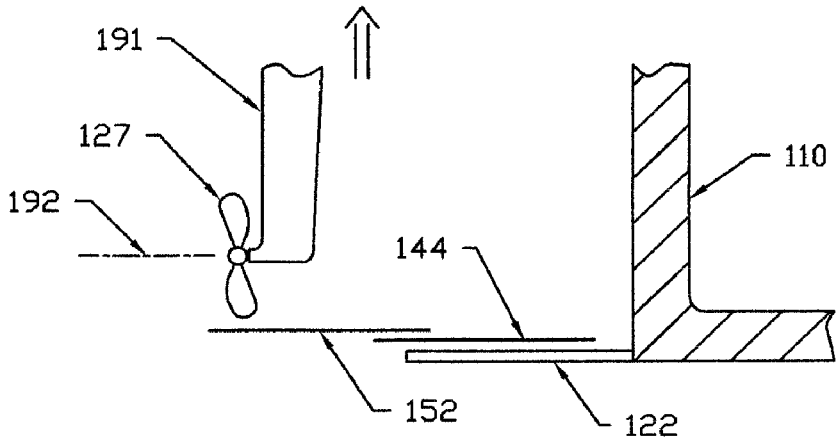
FIG. 21 is a side view of FIG. 20, with the outboard motor in a totally raised position above the trim tab and the trim tab extension in a fully extended position.

FIG. 21 is a side view as the same components as in FIG. 20, but shows the lower unit 191 in a fully raised position such that the propeller 127 is fully above the trim tab 122. This mode is intended for operation at slower speed and when trim tab extension 144 or water screen 152 is extended as shown, the system is "swimmer safe" or "marine mammal safe" by shielding propeller contact injuries from below the propeller. Faster trolling speeds will be attainable when the propeller is fed with sufficient water, therefore, it is advantageous to have the trim tab extension retracted forward as shown because it will not pass any water up through to the propeller, and have the water screen extended to guard the propeller while still passing water up to the propeller.

It is possible to operate with trim tab extension 144 retracted and with water screen 152 fully extended under the propeller and lower unit, however, the speed is limited to trolling speeds because the propeller does not receive sufficient water to fully feed the propeller to permit high speed operation. Although water may spill in from the sides of the boat and over the top of the trim tab, it is not a sufficient quantity of water to feed the propeller. It would be possible to operate the boat at a slow speed with trim tab extension 144 extended rearward to protect the propeller from strikes against foreign objects. Trim tab extension 144 is a solid plate similar to that shown in FIG. 2 and may include a water screen 152 as shown mounted in FIGS. 9 and 10 to serve as a water flow limiting device, but also to serve as a propeller guard. Water screen 152 may be configured as a perforated plate (as shown in FIG. 46), as a wire mesh (as shown in FIG. 47), as a comb (as shown in FIG. 48), or as a rake (as shown in FIG. 49). Any of these four embodiments may be used under the lower unit independently or in conjunction with trim tab extension 144. These four configurations are simply a more porous version of trim tab extension 144. Water is allowed to flow to the propeller and it will do so even if the water has to go over and around the trim tab or trim tab extension. It is simply that the water screens also provide a direct path through to the propeller. The trim tab extension 144, when in the fully extended position under a propeller 127, shields the propeller and therefore acts as a propeller guard to prevent objects from contacting the propeller to cause injury or equipment damage. Therefore, there are times when the trim tab extension functions as a water screen and as a propeller guard and as a propeller screen.

Figure 22:
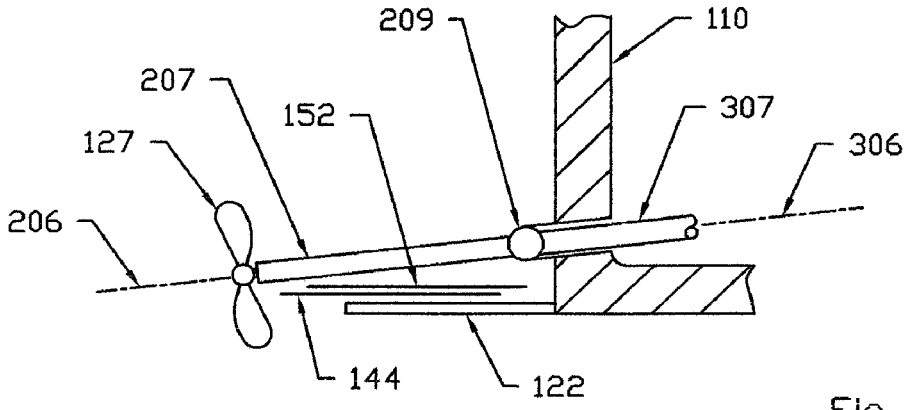
FIG. 22 is a side view of a boat with a trim tab using a surface drive propulsion in a surface piercing position and located above a trim tab with the trim tab extension in a retracted position.

FIG. 22 is a side view of a rear section of a boat and shows a surface drive type of propulsion that has an articulation joint 209 that allows propeller shaft 207 to swing up and down and left and right relative to drive shaft 306. Trim tab 122 is mounted to the stern of the boat 110 and includes a trim tab extension 144 that extends and retracts to control the quantity of water entering the propeller 127. Water screen 152 is shown above the trim tab extension. This configuration is typical for high speed operation but can be used for slow speed or hump speed.

Figure 23:
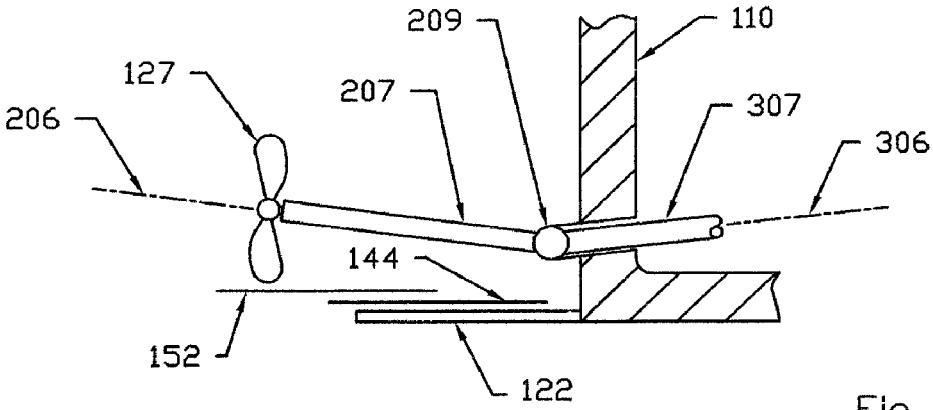
FIG. 23 is a side view of a boat with the surface drive propeller raised above the trim tab and the trim tab extension fully extended rearward.

FIG. 23 is a side view of the same components as in FIG. 22, but shows the surface drive system in a raised position and shows trim tab extension 144 extended rearward under propeller 127 to control the amount of water flooding the propeller. This mode of operation is effective when the boat is at trolling speed and the water can tumble in over the top of the trim tab to feed the propeller. In this mode, the trim tab extension servers to partially limit the flow of water into the propeller and limits the torque load imposed on the propeller by excessive water flow into the propeller. This is advantageous to prevent the engine from lugging due to excessive torque load. In this mode, the trim tab extension may also serve as a propeller guard, or propeller screen, or propeller cage, to prevent propeller strikes and injuries to objects located below the propeller. Alternatively, water screen 152 can be extended or retracted to serve as a propeller guard, or propeller screen, or propeller cage, while still allowing ample water to feed up into the propeller. The correct deployment of the trim tab extension and the water screen are determined by the operating characteristics of the boat including propeller size, engine power, hull type, and desired speed and are determined by operator skill in controlling these operating parameters.

Figure 24:
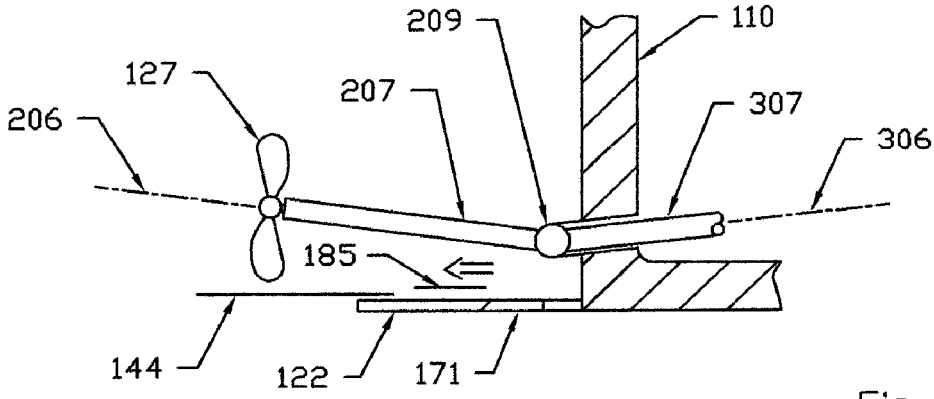
FIG. 24 is a side view of a boat with a surface drive propeller but uses a flood hole as shown in FIG. 16 and slide cover as shown in FIG. 18.

FIG. 24 is a side view of the same components as in FIG. 23 and showing the surface drive in a raised position with the trim tab extension 144 in the rearward position. Flood hole 171 is similar to those shown in FIG. 15 or FIG. 16 or may be similar to forward holes 155 as shown in FIG. 17 or FIG. 18. Forward slide plate 185 closes or opens in a sliding fashion to control the amount of water flooding up through the holes to feed propeller 127.

Figure 25:
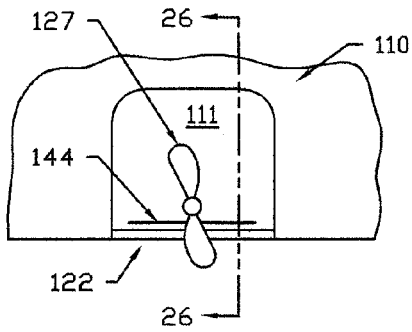
FIG. 25 is a rear end view of a surface drive propeller in a tunnel in the bottom of a boat.

FIG. 25 is a rear end view of a portion of a boat 110 and shows a propeller 127 in a tunnel 111. The tunnel is a cavity in the bottom of the boat and houses the propeller or portions thereof and is common in the industry. The tunnel has a closure in the form of a trim tab 122 similar to the "ground wall" of Buzzi '549. A trim tab extension 144 is added to form a variable area trim tab to better control the amount of water feeding up to the propeller. Trim tab extension 144 is controllable by sliding it forward and rearward as shown in prior figures.

Figure 26:
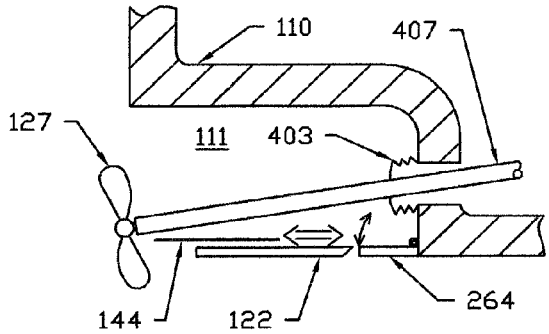
FIG. 26 is a side view of FIG. 25, taken along section line 26-26, and shows a closed flood door in the tunnel closure and a sliding trim tab extension in a partially retracted position.

FIG. 26 is a section view taken along section line 26-26 of FIG. 25, and shows the propeller shaft 407 angled downward into the tunnel 111 at an angle to allow the propeller 127 to be partially below the bottom of trim tab 122. Propeller shaft 407 is made leak tight to the boat hull by means of seal and bellows 403. Trim tab extension 144 slides rearward to decrease the amount of water flooding up into the propeller and slides forward to increase the amount of water flooding up into the propeller in a similar manner as previously described. This slide action is depicted by the double headed bold arrow shown near the trim tab extension. Flood door 264 is closed during high-speed operation to maintain a smooth bottom surface of trim tab 122 as a continuation of the bottom surface of the boat 110.

Figure 27:
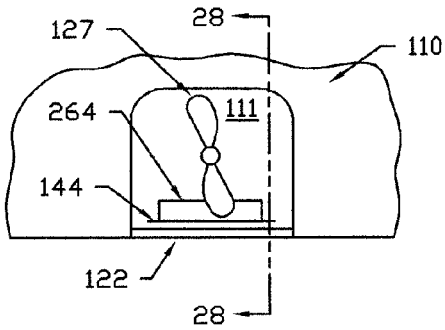
FIG. 27 is the rear end of a boat showing a rear end view of a surface drive propeller in a tunnel in the bottom of the boat, but shows the propeller in the raised position.
Figure 28:
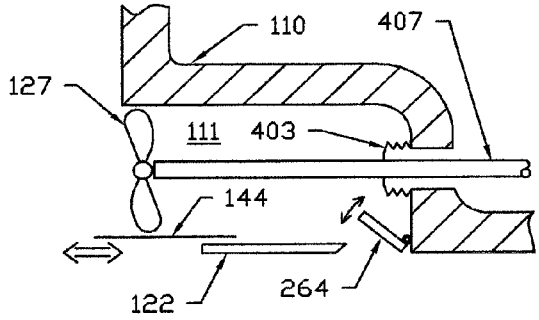
FIG. 28 is a side view of FIG. 27, taken along a section line 28-28, and shows an open flood door in the tunnel closure and a sliding trim tab extension in the extended position.

FIG. 27 is a rear end view of the same boat as shown in FIG. 25, but shows the propeller 127 in the raised position into the tunnel 111 to minimize exposure of the propeller. FIG. 28 is a section view taken along section line 28-28 of FIG. 27 and shows the propeller shaft in the raised position suitable for trolling speeds. In this mode of operation, flood door 264 is opened to allow water to enter the tunnel cavity to feed the propeller 127. Trim tab extension 144 is extended rearward under propeller 127 to serve as a propeller guard. The double headed bold arrow near the trim tab extension shows that the trim tab extension can be slid forward or rearward as desired and can be mounted in guide rails similar to FIG. 7 or other means. A water screen (not shown) can be added to the trim tab as shown in FIG. 9, however it may not contribute much to the flooding of the propeller because flood door 264 can be made amply large without compromising the strength of trim tab 122. The leading edge of trim tab 122 is tapered to minimize drag losses due to water flowing across the bottom of the tab.

Figure 29:
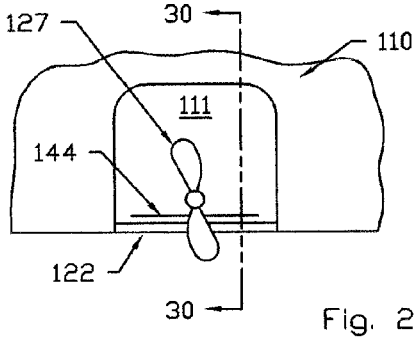
FIG. 29 is a rear end view of a surface drive propeller in a tunnel similar to FIG. 25.
Figure 30:
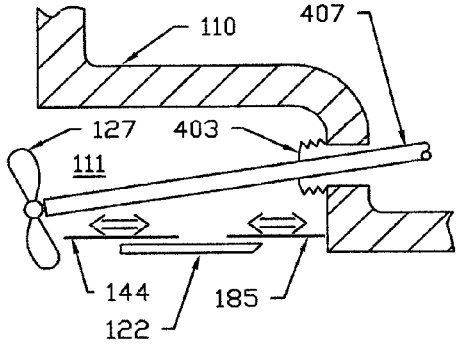
FIG. 30 is a side view of FIG. 29, taken along section line 29-29, and shows the flood hole with a sliding flood control gate and a trim tab extension in the retracted position.

FIG. 29 is a rear end view of a boat with a similar configuration as that shown in FIGS. 25 and 26. FIG. 30 is a section view taken along section line 30-30 of FIG. 29. FIGS. 29 and 30 show a slightly different method to control flooding of the propeller 127. In particular, as shown in FIG. 30, flood control is achieved using forward slide plate 185 to cover the hole similar to flood hole 171 of FIG. 16 located at the forward end of trim tab 122.

Figure 31:
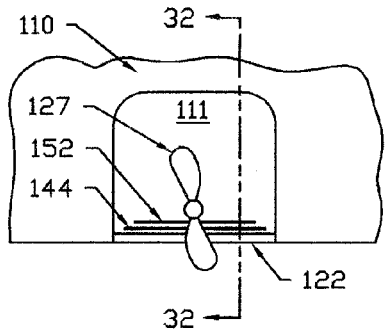
FIG. 31 is a rear end view of a surface drive propeller in a tunnel, similar to FIG. 29, but includes a water screen style propeller cage.
Figure 32:
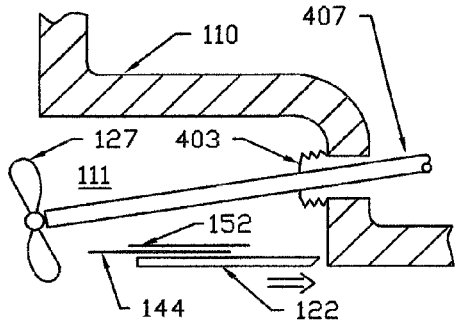
FIG. 32 is a side view of FIG. 31, taken along section line 31-31, and shows the tunnel closure slid to the far forward position.

FIG. 31 is a rear end view of a boat similar to that shown in FIGS. 29 and 30, but including a water screen 152 on top of trim tab extension 144. FIG. 32, which is a section view taken along section line 32-32 of FIG. 31, shows that trim tab 122 can be slid forward and rearward and by virtue of its position act as a means to pass water up into the tunnel to feed propeller 127. When the boat is operating at high speed, trim tab 122 is slid forward as shown to prevent water from flooding up into tunnel 111. Trim tab extension 144 is slid forward or rearward to control the amount of water flooding the propeller. Water screen 152 is positioned on top of trim tab 122 to remain out of the water flow path.

Figure 33:
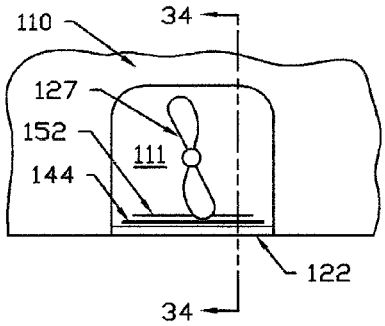
FIG. 33 is a rear end view of a surface drive propeller in a tunnel with the propeller in the raised position above the bottom of the boat.
Figure 34:
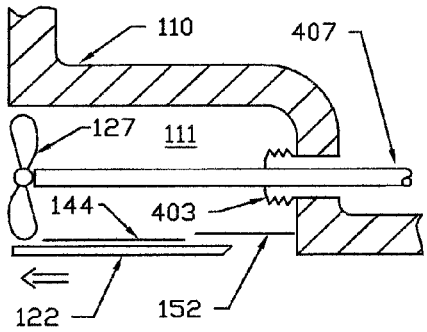
FIG. 34 is a side view of FIG. 33, taken along section line 34-34, and shows the tunnel closure slid to the far rearward position and the water screen slid forward over the front flood hole.

FIG. 33 is a rear end view of a boat similar to that shown in FIGS. 31 and 32, showing propeller 127 in the raised position above the bottom surface of the trim tab 122. FIG. 34, which is a section view along section line 34-34 of FIG. 33, shows propeller 127 in a raised position as suitable for trolling speeds. Trim tab 122 is slid rearward to guard the propeller from any propeller strikes that would cause injury to swimmers. Water screen 152 is slid forward to prevent any trash or objects from entering the tunnel and hitting the propeller.

Figure 35:
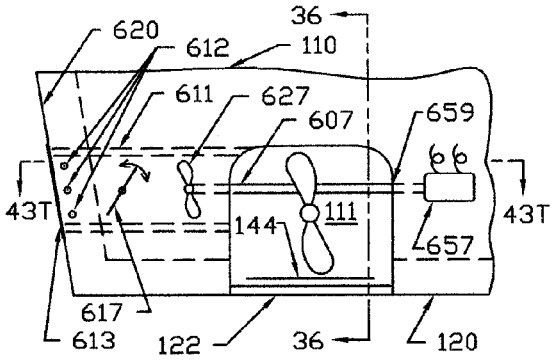
FIG. 35 is a rear end view of a surface drive propeller in a tunnel showing a water feed pipe from the outside of the hull to the tunnel.

FIG. 35 is a rear end view of a boat similar to that shown in FIGS. 33 and 34, but with the addition of a water pipe 611 connecting tunnel 111 to the exterior boat side wall 620. This water pipe 611 is sufficiently large to provide water to propeller 127 when the boat is in the trolling mode. Since the boat is in the displacement mode and sitting deep in the water when it is in the trolling mode, water pipe inlet 613 is fully immersed in the surrounding water. Trash screens 612 prevent objects from being pulled into the tunnel. A flood control valve 617 functions much like flood door 264 of FIG. 26 or forward slide plate 185 of FIG. 18 to control the amount of water flooding into propeller 127 during acceleration over hump speed when the propeller is in the lowered position. A side thruster propeller 627 is mounted inside water pipe 611 and is driven by side thruster propeller shaft 607 that extends across the tunnel 111 and through the tunnel sidewall to thruster motor 657 located in the dry portion of the boat hull. A shaft seal 659 prevents water from entering the boat around side thruster propeller shaft 607. Side thruster propeller 627 pushes or pulls water through water pipe 611 with sufficient force to move the boat sideways.

Figure 36:
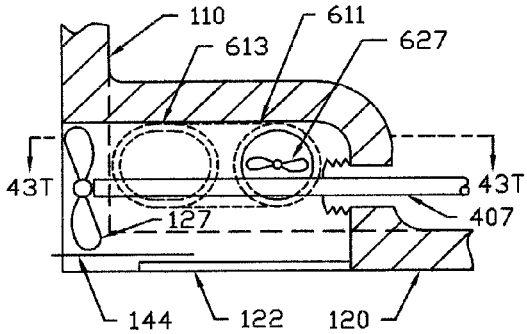
FIG. 36 is a side view of FIG. 35, taken along section line 36-36, showing a water feed pipe with a side thruster propeller enclosed therein.

FIG. 36 is a section view along section line 36-36 of FIG. 35 showing the propeller and shaft of FIG. 34. FIG. 36 shows the water pipe 611 and side thruster propeller 627, but also shows that the water pipe inlet 613 is offset rearward relative to the entrance to the tunnel 111 to illustrate that the water pipe is actually angled backwards where it penetrates the boat hull sidewall 620. This water pipe is angled backwards so that the water pipe is not rammed full of water when the boat is at planing speed, rather, the water is shed away from the inlet. Also, the backward angle helps to nullify any net forward or rearward thrust contribution of the side thrust propeller. Trim tab 122 is stationary and trim tab extension 144 is moved forward when propeller 127 is in the lowered position similar to FIG. 32. FIG. 43T shows the offset of water pipe 611. It is contemplated that the water pipe could be routed straight across from the tunnel 111 to the boat hull sidewall 620 as long as the inlet 613 is beveled rearwards or has a cover plate to prevent water from being rammed into the water pipe when the boat is operating at high speed.

Figure 37:
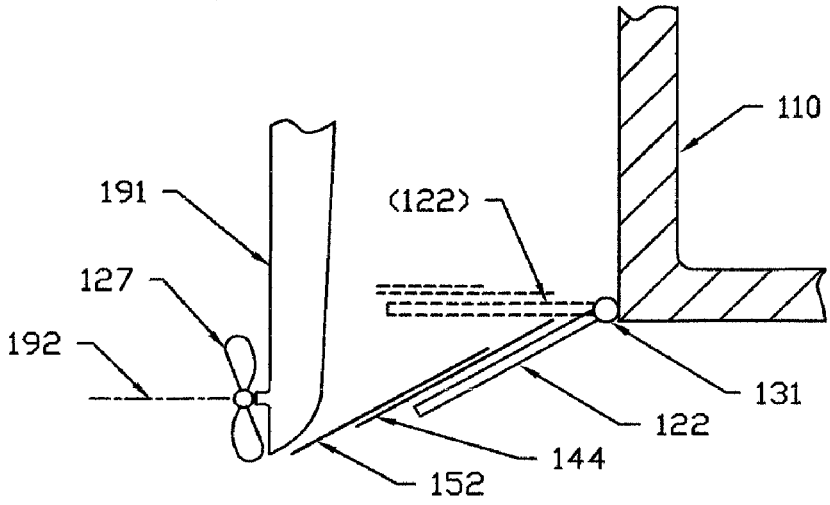
FIG. 37 is a side view of a rear end of a boat, similar to FIG. 19, and shows an outboard motor, or inboard outboard, in a fixed vertical position and a hinged trim tab.

FIG. 37 is a side view of a rear portion of a boat showing an outboard motor or inboard/outboard lower unit 191 in a lowered and fixed position. This arrangement is common to boats that do not have a jack plate or jack box as discussed in FIG. 20. Trim tab 122 is secured to boat 110 by a trim tab hinge 131 that allows the trim tab to be swung up or down by control means, for example, jack screws or hydraulic rams, common to the industry. FIG. 37 shows the trim tab in the lowered position with trim tab extension 144 partially retracted and water screen 152 extended to serve as a propeller guard while still allowing sufficient water to flood the propeller 127. This arrangement is useful for establishing better control on boats that tend to have a high bow when operating at high trolling speeds. This is because the sharp down angle of the trim tab will force the bow of the boat down and the water screen will protect the propeller from strikes. A dashed line shows the trim tab 122 in a raised position.

Figure 38:
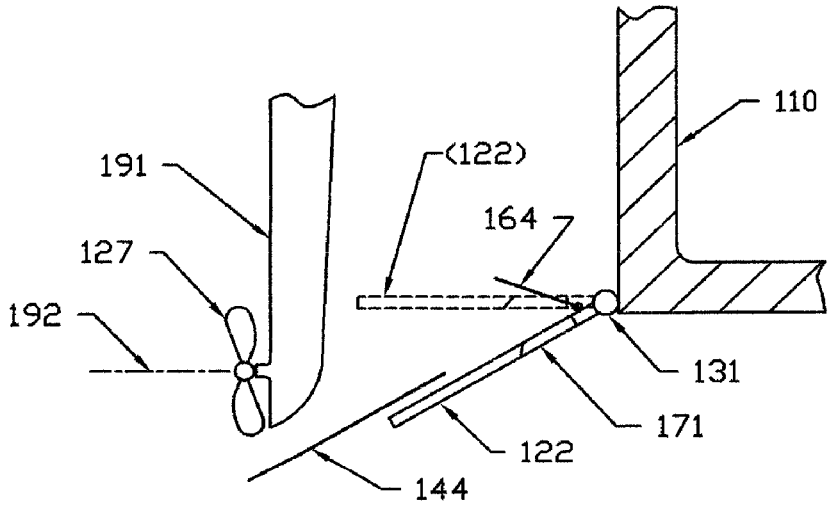
FIG. 38 is a side view of the rear end of a boat with the trim tab extension in the rearward position, but includes a flood hole in the trim tab.

FIG. 38 is a side view of a rear portion of a boat showing trim tab hinge 131 and trim tab 122 with a flood door 164 and flood hole 171 as shown in FIG. 16 to allow extra water to flood propeller 127. A dashed line shows trim tab 122 in a raised position. Trim tab extension 144 is extended rearward to serve as a solid propeller guard. This is an example of a trim tab extension having a dual role as a planing surface and as a propeller guard or propeller screen.

Figure 39:
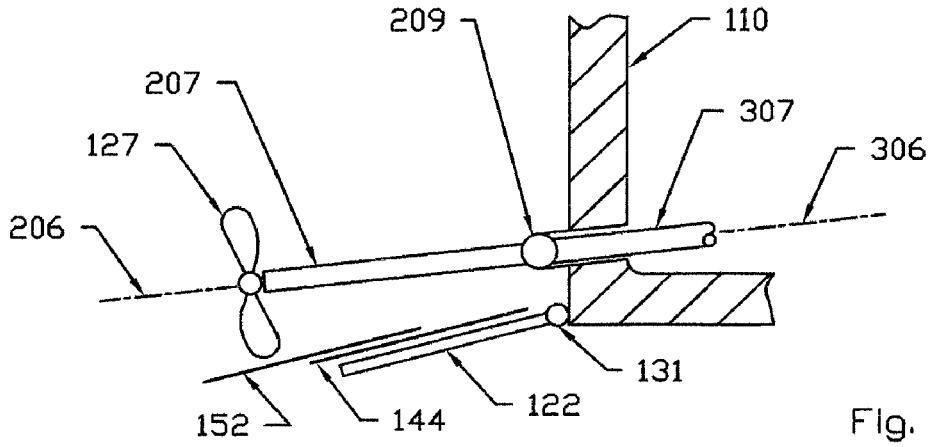
FIG. 39 is a side view of the rear end of a boat showing a surface drive in a fixed vertical position but with a hinged trim tab.
Figure 40:
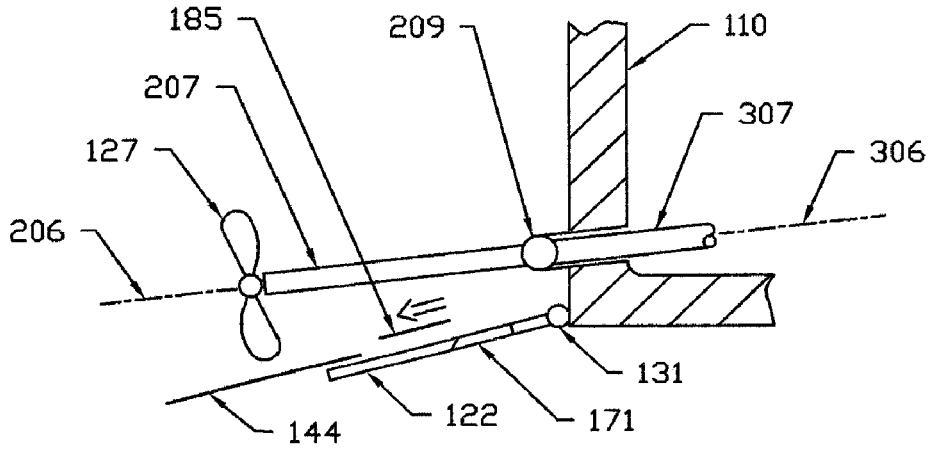
FIG. 40 is a side view of the rear end of a boat with the trim tab extension in the rearward position and includes a flood hole in the trim tab.

FIG. 39 is a side view of a rear portion of a boat with an articulating surface drive showing a trim tab 122 mounted to boat 110 by a trim tab hinge 131 and showing water screen 152 extended at the rearward end similar to FIG. 37. FIG. 40 is a side view of a rear portion of a boat with an articulating surface drive with a trim tab 122 mounted to boat 110 by trim tab hinge 131 and showing flood hole 171 and forward slide plate cover 185 to control the amount of water flooding propeller 127 similar to FIG. 16 and FIG. 18.

Figure 41:
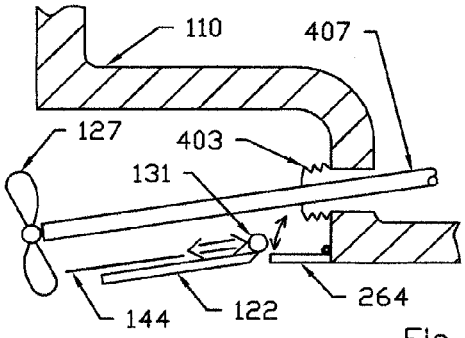
FIG. 41 is a sectional side view of a tunnel propeller with a hinged trim tab.

FIG. 41 is a sectional side view of the rear end of a boat with a propeller in a tunnel cavity further showing the trim tab 122 mounted to trim tab hinge 131 to enable the assembly to swing down to act as a more responsive trim tab compared to a trim tab of prior art "ground wall" that does not swing down. Trim tab extension 144 and flood door 264 both function as described before in FIG. 26 to control the amount of water flooding the propeller. FIG. 41 is representative of the boat operating at a high speed in the surface piercing mode with a small amount of trim tab deflection downward to raise the stern of the boat and push the bow down. Flood door 264 may be part of, or separate from, trim tab 122.

Figure 42:
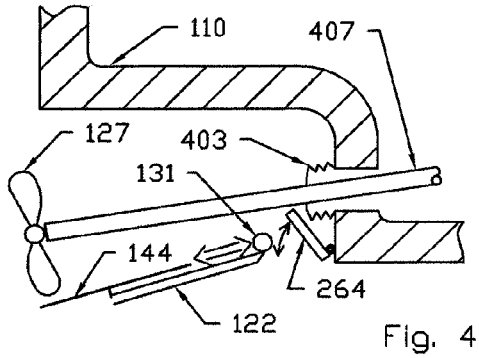
FIG. 42 is a sectional side view of the same boat as shown in FIG. 41, but with the trim tab extension in the rearward position, and the flood hole open.

FIG. 42 is a sectional side view of the rear end of a boat, having the same components of FIG. 41, but showing the trim tab 122 swung down on trim tab hinge 131 and operating in a trolling mode. Trim tab extension 144 is extended rearward to serve as a propeller guard for propeller 127 and flood door 264 is opened to allow water to flood the propeller.

Figure 43:
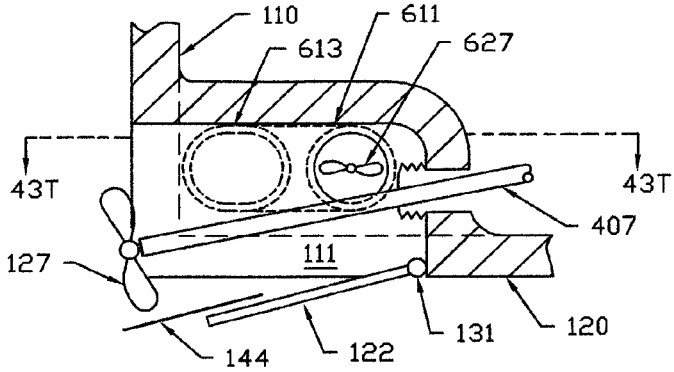
FIG. 43 is a side view taken along section line 36-36 of FIG. 35, but with a hinged trim tab in the down position.
Figure 43T:
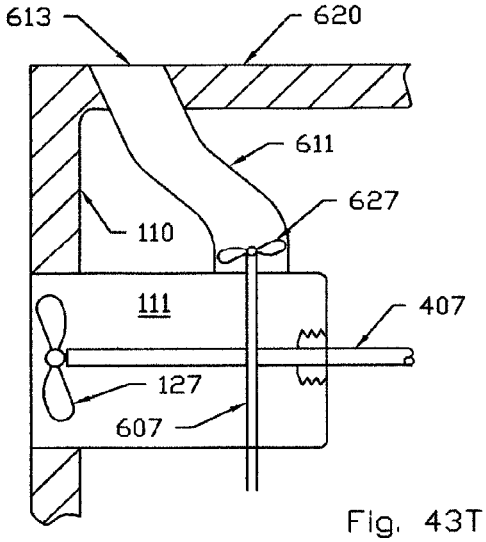
FIG. 43T is a top view of FIG. 43, taken along section line 43T-43T of FIG. 43, showing the water feed pipe connecting the tunnel to the side of the boat.

FIG. 43 is a sectional side view of the rear end of a boat with a propeller in a tunnel and trim tab 122 mounted to boat 110 by trim tab hinge 131. Trim tab extension 144 can be extended or retracted as desired to serve as both a trim tab extension and as a propeller guard. This improvement allows the trim tab to swing down to act as a more responsive trim tab compared to a "ground wall" trim tab that does not swing down. This figure is typical of the boat operating in the trolling mode with trim tab extension 144 extended to serve as a propeller guard and water entering tunnel 111 via water pipe 611.

FIG. 43T is a sectional top view taken along section line 43T-43T of any of FIG. 43, 35, or 36 showing the rearward offset of water pipe 611 to show how the water inlet 613 at the exterior boat side wall 620 is located rearward of the water inlet to the tunnel 111.

Figure 44:
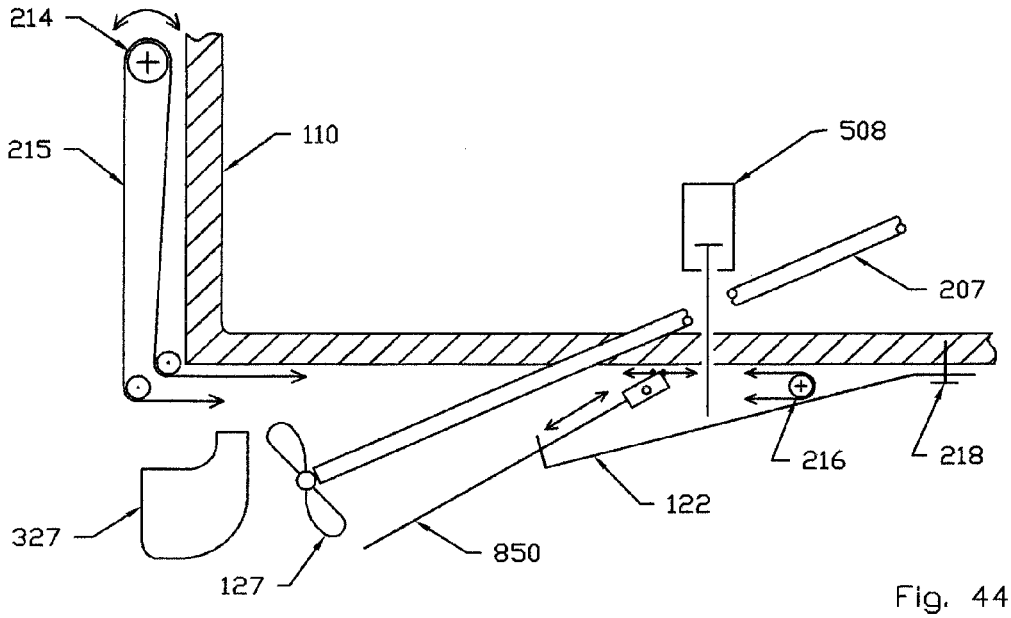
FIG. 44 is a sectional side view of a boat showing a straight drive inboard boat propeller and trim tab with the propeller guard deployed.

FIG. 44 is a partial sectional side view of a boat 110 with a straight drive propeller shaft 207 that turns propeller 127 and is steered by rudder 327. Trim tab 122 is attached to the bottom of the boat by screws 218 and flexes near that attachment point to allow it to be pushed up or down by trim tab ram 508 to vary the amount of trim added to the boat. A cable mechanism similar to that shown in FIG. 13 generates a push and pull on water screen 152 to extend it as a propeller guard. Details of construction can better be seen in FIG. 45 and FIG. 48.

Figure 45:
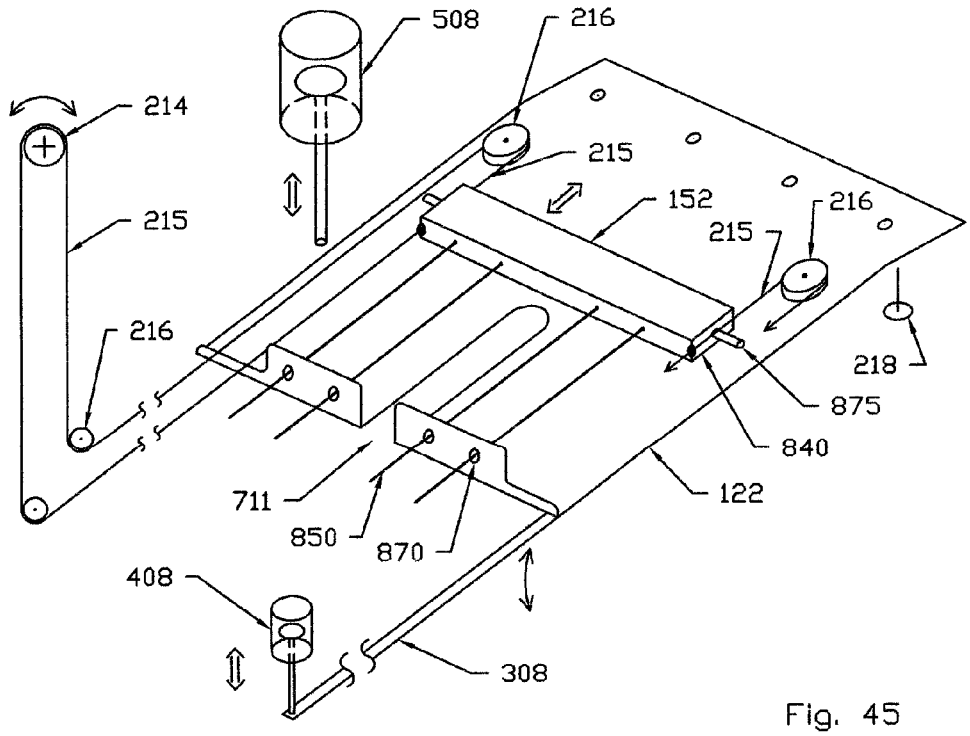
FIG. 45 is a perspective view of the trim tab of FIG. 44, and shows construction details of the trim tab adjustment and propeller guard deployment means.

FIG. 45 is a perspective view of the trim tab and propeller guard of FIG. 44 with additional construction details. Trim tab 122 is made of thin stainless steel sheet metal or similar resilient material. Water screen 152 is made of stiff tines 850 fastened to a back bar 840 and appears much like a coarse comb or pitchfork and is shown and discussed in FIG. 48. Drive pulley 214 rotates to move cable 215 around idler pulleys 216 to cause water screen 152 to shift forward and rearward relative to trim tab 122. Tines 850 slide through tine holes 870 and guide pins 875 run in tracks, not shown, but similar to guide rails 146 shown in FIG. 5, 6, or 7. These tracks are mounted along the hull bottom to constrain the back bar 840 to move along the hull bottom while the rearward ends of tines 850 are forced to swing down to protect the propeller 127 as trim ram 508 pushes downward on trim tab 122. Water screen 152 is shown as a comb-like assembly, however a perforated plate of FIG. 46, or a wire mesh screen of FIG. 47, or a rake of FIG. 49, could also be used. Shaft notch 711 allows trim tab 122 to straddle propeller shaft 207 when the trim tab is in the upward position hugging the bottom of the boat.

An alternative to trim ram 508 shows trim ram 408 that is mounted behind the transom at a location outside of the hull similar to drive pulley 214. Use of trim ram 408 obviates the need for trim ram 508 and its hull penetration and shaft seal. Trim ram 408 is connected to the rearward end of arms 308 forming a matched pair that are connected to both side edges of trim tab 122.

FIG. 46 is a perspective view of a water screen 152 that is comprised of a resilient plate with large perforations 810 through the plate to allow water to pass through to flood the propeller as previously discussed.

FIG. 47 is a perspective view of a water screen 152 that is comprised of a rigid frame 830 and laced with wires to form a wire mesh 820 to allow water to pass through to flood the propeller as previously discussed.

FIG. 48 is a perspective view of a water screen 152 that is similar to a coarse comb or pitchfork as discussed in FIG. 1, 44, or 45 and is constructed of stiff tines 850 fastened to a back bar 840. The tines may be tapered or oval shape to give maximum stiffness and minimum water resistance. The tines are blunt on the end to prevent injury to swimmers.

FIG. 49 is a perspective view of a water screen 152 that is similar to a rake constructed of a flat plate with tapered teeth 860. This figure is an example of a construction that has characteristics of both a trim tab and a water screen in that it provides added hydrodynamic lift yet it allows water to flow through it.

Although the present invention has been described in considerable detail with reference to certain preferred versions thereof, other versions and variations are possible and contemplated. Those skilled in the art should appreciate that they can readily use the disclosed conception and specific embodiments as a basis for designing or modifying other structures for providing out the same purposes of the present invention without departing from the spirit and scope of the invention as defined by the appended claims.

The invention claimed is:

1. A variable area trim tab system for a boat, comprising:

a first trim tab having a first area along a first planar surface wherein said first area forms at least a portion of an effective trim tab area, and wherein said first trim tab comprises a plate with at least one flood hole; and a second trim tab coupled to said first trim tab which adjusts a second area along a second planar surface generally parallel to said first planar surface to adjust said effective trim tab area, wherein said second trim tab comprises an adjustable flood cover for selectively covering said at least one flood hole.

2. The variable area trim tab system of claim 1, wherein said second trim tab comprises an adjustable trim tab extension slidably mounted to said first trim tab.

3. The variable area trim tab system of claim 2, further comprising a propeller guard slidably mounted to said first trim tab.

4. The variable area trim tab system of claim 1, wherein said first trim tab is hingedly connected near a rearward portion of a bottom surface of the boat.

5. The variable area trim tab system of claim 2, wherein said first trim tab comprises a first portion for mounting near a bottom of a transom of the boat and a second portion that is hingedly mounted to said first portion, and wherein said adjustable trim tab extension is slidably mounted to said second portion of said first trim tab.

6. The variable area trim tab system of claim 5, further comprising a flood door mounted to said first portion of said first trim tab.

7. The variable area trim tab system of claim 1, wherein:

said first trim tab comprises upper and lower portions forming a pocket; and wherein said second trim tab adjustably extends from said pocket.

8. The variable area trim tab system of claim 1, wherein:

said first trim tab comprises a fixed hull extension of the boat; and wherein said second trim tab adjustably extends above said hull extension.

9. The variable area trim tab system of claim 1, wherein said adjustable flood cover comprises a flood door coupled to a flood door hinge mounted to said first trim tab that selectively covers said at least one flood hole.

10. The variable area trim tab system of claim 1, wherein said adjustable flood cover comprises at least one slide plate that slides on said first trim tab to selectively cover said at least one flood hole.

11. The variable area trim tab system of claim 1, wherein said adjustable flood cover further comprises an adjustable trim tab extension.

12. The variable area trim tab system of claim 1, wherein:

said first trim tab comprises an adjustable plate which is slid forward and rearward to adjust its position; and wherein said second trim tab adjustably extends above said first trim tab.

13. The variable trim tab system of claim 12, further comprising a propeller guard slidably mounted to said adjustable plate.

14. A variable area trim tab system for a boat, comprising:

a first trim tab having a first area along a first planar surface wherein said first area forms at least a portion of an effective trim tab area;

wherein said first trim tab comprises an adjustable plate which is slid forward and rearward to adjust its position and a flood hole which is positioned between the boat and said adjustable plate in which said flood hole has a variable effective trim tab area based on said position of said adjustable plate;

a second trim tab coupled to said first trim tab which adjusts a second area along a second planar surface generally parallel to said first planar surface to adjust said effective trim tab area, wherein said second trim tab adjustably extends above said first trim tab; and a propeller guard slidably mounted to said adjustable plate.

15. The variable trim tab system of claim 1, further comprising a flood door.

16. The variable trim tab system of claim 1, wherein said second trim tab comprises an adjustable propeller guard extension slidably mounted to said first trim tab.

17. A boat, comprising:

a hull; and a variable area trim tab mounted to said hull, comprising:

a first trim tab mounted to said hull and having a first area along a first planar surface wherein said first area forms at least a portion of an effective trim tab area;

a second trim tab adjustably mounted to said first trim tab which adjusts a second area along a second planar surface generally parallel to said first planar surface to adjust said effective trim tab area; and wherein said first trim tab includes at least one flood hole and wherein said second trim tab comprises an adjustable cover which is positioned to selectively cover said at least one flood hole.

18. The boat of claim 17, wherein said second trim tab comprises an adjustable trim tab extension slidably mounted to said first trim tab.

* * * * *